US005272093A

United States Patent [19]

Silva et al.

[11] Patent Number: 5,272,093

[45] Date of Patent: Dec. 21, 1993

[54] REAGENT CONTAINMENT AND DELIVERY TRAY AND METHOD OF USE

[75] Inventors: James J. Silva, Elkhart; Frank W. Wogoman, Granger, both of Ind.

[73] Assignee: Miles Inc., Elkhart, Ind.

[21] Appl. No.: 868,558

[22] Filed: Apr. 14, 1992

Related U.S. Application Data

[63] Continuation of Ser. No. 561,957, Aug. 2, 1990, abandoned.

[51] Int. Cl.[5] ..... B01L 3/00

[52] U.S. Cl. ..... 436/180; 422/61; 422/100; 422/102; 206/569; 206/822

[58] Field of Search ..... 206/484, 469, 606, 613, 206/633, 634, 822, 569; 422/102, 99, 100, 61; 436/180

[56] References Cited

U.S. PATENT DOCUMENTS

| | | | |
|---|---|---|---|
| 2,898,003 | 8/1959 | Wilson et al. | 206/613 |
| 3,316,839 | 5/1967 | Lake | 206/613 |
| 3,505,031 | 4/1970 | Moore et al. . | |
| 3,705,000 | 12/1972 | Guerra . | |
| 3,862,684 | 1/1975 | Schmitt | 206/484 |
| 3,913,734 | 10/1975 | Siegel | 206/484 |
| 4,390,499 | 6/1983 | Curtis et al. | 422/102 |
| 4,573,614 | 3/1986 | Ozawa | 206/633 |
| 4,648,506 | 3/1987 | Campbell | 206/469 |
| 4,707,200 | 11/1987 | Giebel et al. | 206/633 |
| 4,871,091 | 10/1989 | Preziosi | 206/484 |
| 4,883,763 | 11/1989 | Holen | 422/102 |
| 5,162,237 | 11/1992 | Messenger | 422/102 |

OTHER PUBLICATIONS

Fisher Scientific Catalog, 1988 pp. 74–75.

*Primary Examiner*—James C. Housel
*Assistant Examiner*—Jan M. Ludlow
*Attorney, Agent, or Firm*—Andrew L. Klawitter; Jerome L. Jeffers

[57] ABSTRACT

A high-precision liquid reagent delivery system is provided for convenient and efficient gravity flow delivery of substantially the entire volume of reagent contained within a sealed formed tray. The delivery system comprises a formed tray defining a curved cavity for holding a predetermined amount of liquid, and a substantially planar ledge surface defined around the cavity opening. The surfaces of the cavity are non-porous, uniform and smoothly converging to a point of liquid discharge at an intersection of the cavity and the ledge surface. The ledge surface further defines an apex extending longitudinally from the point of liquid discharge and defines a guide path for the delivery of liquid contained within the tray. The system also includes a flexible cover removably affixed to the ledge surface of the tray for forming a sealed chamber between the cavity and the affixed cover for containment of liquid. The cover extends beyond the apex of the ledge surface to define a tab portion which can be grasped and pulled from the ledge surface to remove the cover. Removal of the flexible cover in such a manner with the tray positioned in a upstanding manner with the point of liquid discharge directed downward provides gravity flow delivery of all liquid contained within the tray with a low coefficient of variation.

27 Claims, 6 Drawing Sheets

REAGENT CONTAINMENT AND DELIVERY TRAY AND METHOD OF USE

This is a continuation of application Ser. No. 561,957, filed on Aug. 2, 1990, now abandoned.

BACKGROUND OF THE INVENTION

1. Field of the Invention

The present invention generally relates to single-dose disposable containers for delivering reagents, medical solutions and the like. More particularly, this invention relates to an improved reagent containment and delivery tray for efficient gravity flow delivery of liquid reagent contained therein.

2. Description of the Prior Art

In a variety of medical and laboratory applications, it is necessary for various liquid medicaments and other fluids and reagents to be packaged in small glass or plastic "unit-dose" containers or vials which hold a small quantity of fluid, usually the amount normally required for a single dose to be used for patient administration or other application-specific purposes.

In laboratory applications, in particular, diagnostic tests typically require the input of precise amounts of liquid reagent at one or more points in the assay procedure used with the tests. In such cases, it is critical that the unit-dose container provide efficient delivery of a precise volume of liquid analytical reagent with a finely controlled coefficient of variation. Reagent delivery arrangements for such diagnostic test systems are generally expected to satisfy the following basic requirements: (i) low cost; (ii) extended shelf life (typically, at least about 18 months); (iii) delivery coefficients of variation ("CV") of about 1% independent of operator actuation; and (iv) a reagent containment capacity of up to 1 milliliter (mL).

Presently, the most commonly employed means of supplying and delivering precise amounts of reagent or fluid in a disposable container consists of a sealed container such as a glass syringe barrel prepacked with the liquid reagent contained between a movable piston and a septum which is pierced by the exertion of mechanical force using a needle-like member provided within or outside the system. The arrangement is such that the application of mechanical force to the movable piston following piercing of the septum drives out the liquid reagent contained within the syringe barrel. Such delivery systems are fairly expensive and mechanically complex and are generally incapable of high precision delivery of accurate amounts of liquid reagent contained within the syringe.

Another commonly employed delivery system is the use of sealed glass ampules or vials which are either (i) penetratable by syringes or like devices at the point of application for extracting the requisite dosage of reagent stored therein or (ii) adapted to be broken or otherwise opened up at the point of use. Such systems suffer from a marked lack of precision in delivery since expulsion of the total volume of the contained fluid cannot be ensured and also due to the uncontrollable nature of the glass particles produced when the vials are broken. Further, glass vials are relatively expensive and require careful handling to prevent accidental breakage and rigid quality control procedures to detect minute cracks in the vials or glass particles in the fluid contained within the vials.

Although many of these shortcomings are avoided by the use of plastic vials, penetratable containers or vials made of both plastic and glass are susceptible to cutting or coring of the material used to form the penetratable portions during insertion of the needle or like member. Accordingly, these arrangements are susceptible to serious contamination problems because of the possibility that particles of the container material may either fall into the vial or become lodged in the lumen of the extracting device.

As a result, there exists a distinct need for a low-cost, high-precision liquid containment and delivery system which is particularly adapted to the accurate and convenient delivery of extremely small unit doses of the order of about 1 mL.

SUMMARY OF THE INVENTION

In view of the foregoing, it is a general object of the present invention to provide an improved arrangement for the accurate delivery of small volumes of liquid analytical reagents.

In this regard, it is a specific object of this invention to provide an improved liquid reagent containment and delivery tray which is capable of storing and dispensing small volumes of liquid reagent with high precision.

A related object of this invention is to provide a reagent containment and delivery tray of the above kind which is particularly adapted for accurate gravity flow delivery of the entire volume of liquid reagent contained within the tray with a substantially reduced coefficient of variation.

Yet another object is to provide such a reagent delivery tray which is adapted to be used with flexible cover means for tightly sealing in the liquid reagent within the containment cavity and for dispensing the liquid reagent by convenient removal of the flexible cover means at the time of use.

Briefly, in accordance with this system of this invention, the above-identified and other objects are realized by the provision of a reagent containment and delivery system essentially comprising (i) a formed tray defining a smoothly curved cavity having a substantially teardrop shape and adapted to contain a predetermined amount of liquid to be delivered therefrom, and (ii) a flexible cover removably affixed to the formed tray to seal the cavity formed therein, thereby defining a sealed chamber between the cavity and the affixed cover for the containment of liquid therein. The surfaces of the liquid containment cavity are non-porous, uniform, and converge smoothly to a point of liquid discharge defined at an intersection of the cavity with a substantially planar ledged surface defined around the opening of the cavity. The surrounding ledge surface extends outwardly from the cavity opening and forms an apex extending longitudinally from the point of liquid discharge to define a smooth guide path for directing liquid out of the containment cavity.

In accordance with a preferred embodiment, the flexible cover is removably affixed to the ledge surface of the formed tray and extends beyond the apex thereof so as to define a tab portion which can be grasped and pulled from the ledge surface to remove the cover therefrom. The combination of the uniform and smoothly converging cavity surfaces and the guide path defined by the apex of the ledge surface extending longitudinally from the point of liquid discharge reduces to a minimum any capillary action or other fluid retaining forces resulting from contact between the liquid and the containing surfaces as the liquid is delivered out of the containment cavity.

In particular, the arrangement is such that removal of the flexible cover from the ledge surface of the formed tray by grasping and pulling the tab portion from the ledge surface, with the tray maintained in an upstanding position with the point of liquid discharge directed downward, realizes gravity flow delivery of substantially the entire volume of liquid contained within the tray.

Also according to a preferred embodiment, the flexible cover is affixed to the ledge surface of the formed tray by bonding means which leaves substantially no residue upon removal of the cover. Further, the tray is constructed to be sufficiently rigid that no substantial deformation of the cavity occurs as the flexible cover is removed. Both the tray and the flexible cover are formed of materials which are substantially vapor impermeable.

Preferably, the tab portion of the cover which extends beyond the apex of the ledge surface is folded back upon itself and further extends beyond the edge of the ledge surface distal to the apex. The extended tab functions as a convenient means for removal of the cover as the containment and delivery tray is used in conjunction with a reagent mixing chamber into which the contained liquid is to be delivered, with the tray being maintained in an upstanding position with the point of liquid discharge directed downward and in close proximity with a support surface on the mixing chamber.

BRIEF DESCRIPTION OF THE DRAWINGS

Other objects and advantages of the present invention will become apparent upon reading the following detailed description and upon reference to the drawings in which.

Figure 1:
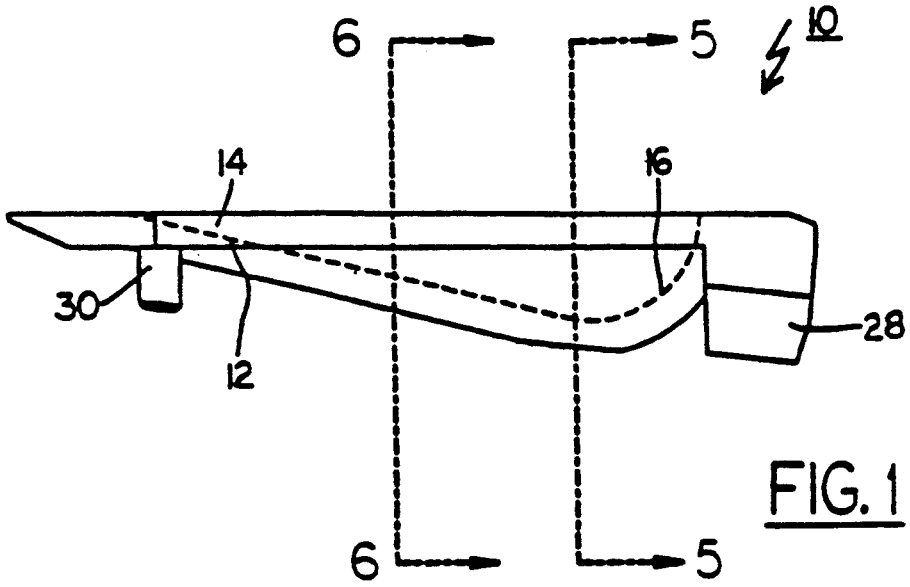
FIG. 1 is a side view of a liquid reagent containment and delivery tray, according to a preferred embodiment of this invention.
Figure 2:
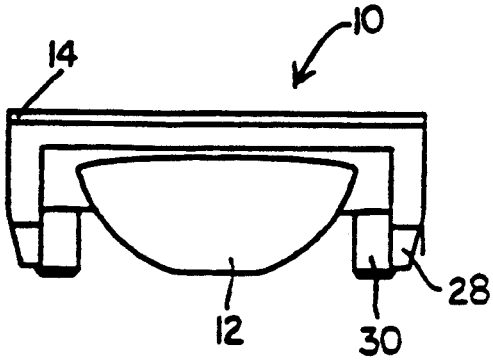
FIG. 2 is an end view of the reagent tray shown in FIG. 1.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Referring now to the drawings, FIGS. 1–6 collectively provide several views of an illustrative embodiment of a liquid reagent containment and delivery tray in accordance with the system of this invention. As shown therein, the tray 10 defines a curvilinear cavity 12 adapted to function as a reservoir for containing therein the liquid reagent which needs to be subsequently delivered. The cavity 12 depends downwardly from an oblong, substantially teardrop-shaped opening 13 defined by a broad curved section 16 which converges on either end through curvilinear sides 18 to a narrow end about which a point of liquid discharge 20 is defined.

The cavity 12 is defined about the teardrop-shaped opening in such a way that it has a maximum depth about the broad curved section 16, with the depth of the cavity gradually reducing to a minimum point at the point of discharge 20. In essence, the liquid containment cavity 12 is defined all around by smoothly curved surfaces which are devoid of any angular sections or obstructions which may serve as points of capillary reaction or other surface interactions resulting in retention of fluid within the tray as the delivery action takes place.

The teardrop-shaped opening 13 and the liquid containment cavity 12 dependent therefrom are themselves contiguous with a substantially planar ledge surface 14 which is defined around the opening of the cavity 12. The arrangement is such that the surfaces of the cavity 12 converge smoothly up to the point of liquid discharge 20 at the intersection of the cavity with the ledge surface 14 at the narrow end of the teardrop-shaped opening. The ledge surface 14 itself essentially defines a substantially rectangular enclosure around the cavity opening. However, at the narrow end of the cavity opening, the ledge surface converges down to an apex 22 which extends longitudinally from the point of liquid discharge 20. The apex 22 is essentially formed by angular surfaces 24 and 26 which, according to the illustrative embodiment represented by the drawings, are formed to converge to a single, sharp point of liquid discharge along the longitudinal axis of the cavity opening.

It should be understood that the particular shape of the apex region of the present device is not critical provided that it serves the function of delivering the contained liquid and, in the case where a small, but significant amount of liquid is retained on the ledge surface at the apex, of positioning the residual liquid in such a way as to be removed by subsequent washing of the apex region. Accordingly, the apex portion may converge to a rounded section instead of a sharp point, or can be of any other such functional shape including extended flat edges and the like.

Preferably, the reagent containment tray, including the ledge surface 14 and the cavity 12, is fabricated as a molded component formed of a plastic material, preferably high-density polyethylene, the external surface of which has integrally bonded thereto an aluminum foil, plastic laminate serving as a water vapor barrier on the plastic material from which the tray is molded.

Figure 3:
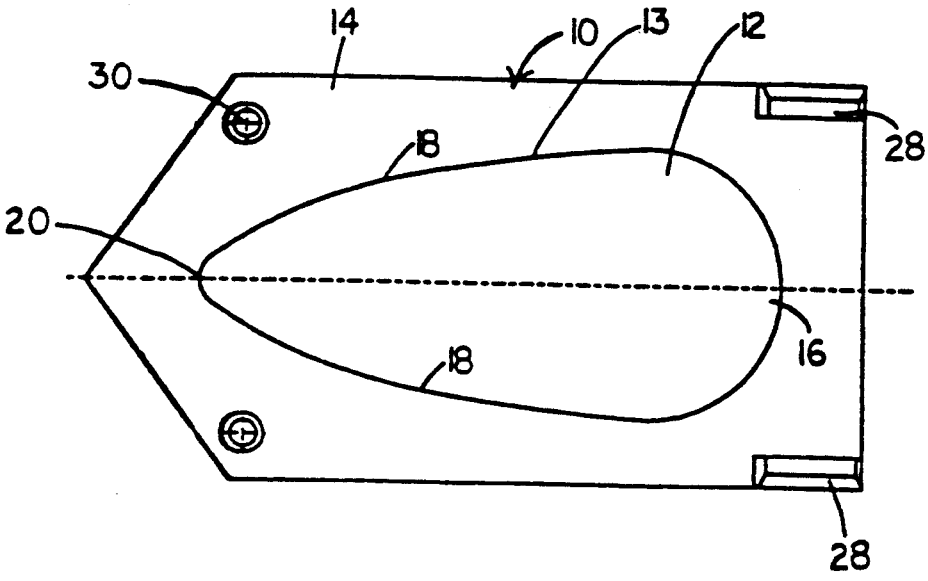
FIG. 3 is a bottom view of the reagent tray of FIG. 1.
Figure 4:
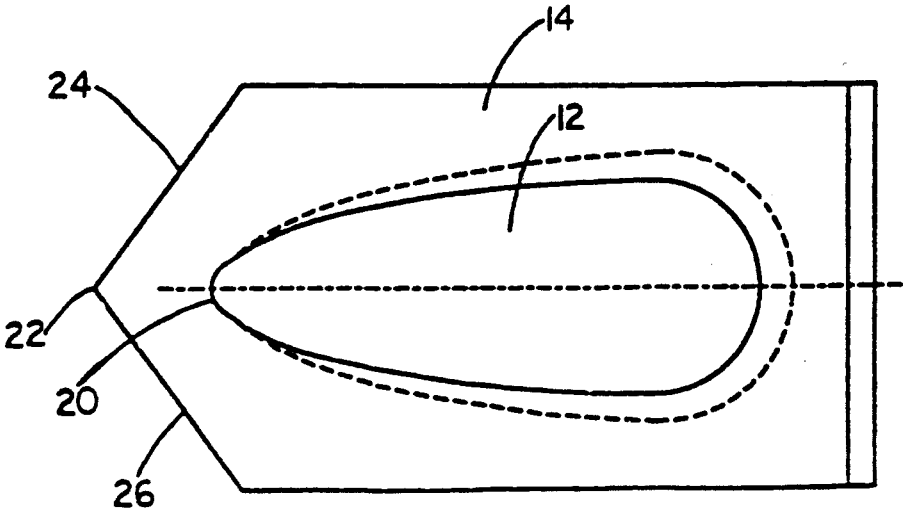
FIG. 4 is a top view of the reagent tray of FIG. 1.
Figure 5:
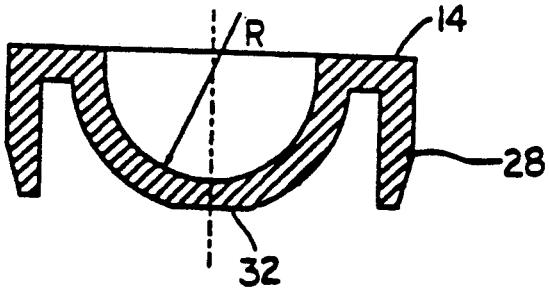
FIG. 5 is a sectional end view of the reagent tray taken along line A—A in FIG. 1.

As best seen in FIGS. 3 and 5, the external surface of the molded cavity includes a substantially flat section 32 and the tray body is provided with a pair of narrow rectilinear support members 28 which depend downwardly from the ledge surface 14 of the tray about the broad curved section 16 of the cavity opening. In addition, the ledge surface 14 is provided with downwardly dependent cylindrical support members 30 disposed about the narrow end of the cavity opening. In combination, the rectangular support members 28, the cylindrical support members 30 and the flat outer section 32 of the cavity serve as means for assisting in supporting the tray within a reagent mixing chamber or a reaction cartridge into which liquid reagent contained within the tray 10 is to be dispensed.

It should be noted that the support members are shown here by way of illustration only and any other means for cooperating with corresponding support means (not shown) provided in the reaction cartridge assembly itself may be used. For purposes of describing the present invention, it suffices to state that the support members on the reagent tray essentially cooperate with corresponding support means on the cartridge assembly in such a way that the reagent containment and deliver tray 10 may be supported within the reaction cartridge in an upstanding position with the point of liquid discharge directed downwardly and the apex defined by the ledge surface in proximity with a support surface on the reaction cartridge. In such an arrangement, it is preferred that the vertical distance between the apex of the ledge surface of the preformed tray and the support surface on the reaction cartridge be less than the vertical height of the liquid that results on the support surface in the reaction cartridge upon discharge of the liquid reagent from the tray.

The present device is particularly designed for the precise delivery over time of a liquid reagent. While the device finds particular use in the field of chemical analysis, e.g., medical diagnostic analysis, it will be evident that the present invention is similarly applicable to situations using other types of liquid reagents and requiring precise volume delivery for their effective use. Accordingly, as illustrative examples, and not by way of limitation, the liquid reagent can be a complex mixture or solution of chemical, biological, or immunochemical agents, a mixture, solution, or suspension of a single agent, a buffer solution, or a solvent such as an organic liquid or even water alone.

An essential attribute of the present invention is its ability to provide precise delivery of a prescribed volume of any such liquid reagent, no matter how complex or simple, in applications where the volume of liquid delivery is critical, such as in the performance of quantitative chemical, biological, and immunochemical analyses. While, in general, the contained volume of the liquid reagent is not critical, the present invention will normally find its most useful applications for liquid volumes of less than about 2 ml, and, more preferably, in the range of from about 0.25 ml, up to about 1 ml.

Figure 7:
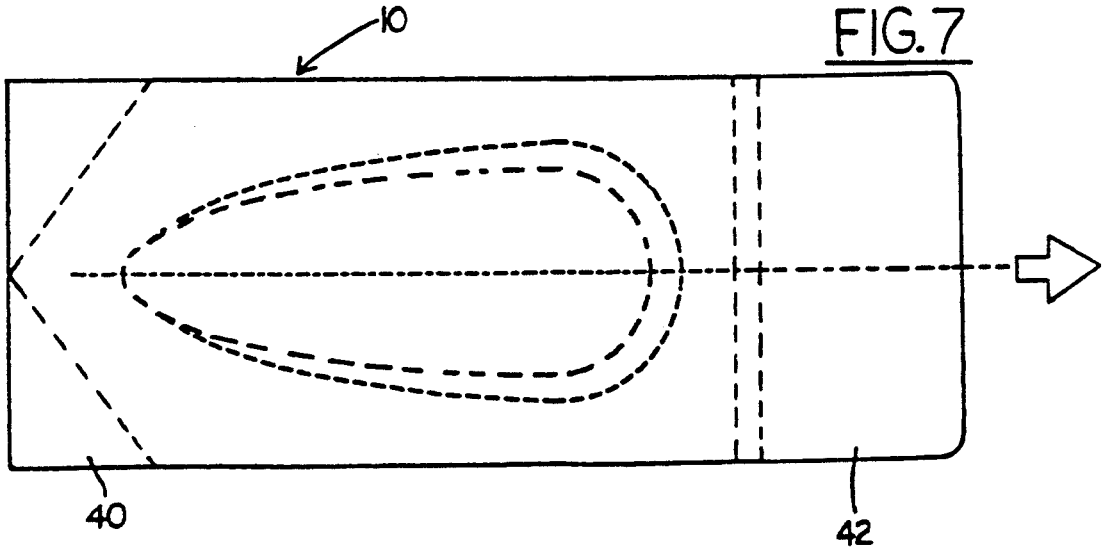
FIG. 7 is a top view showing the illustrative reagent tray of FIG. 1 with a flexible sealing cover affixed thereto.
Figure 8:
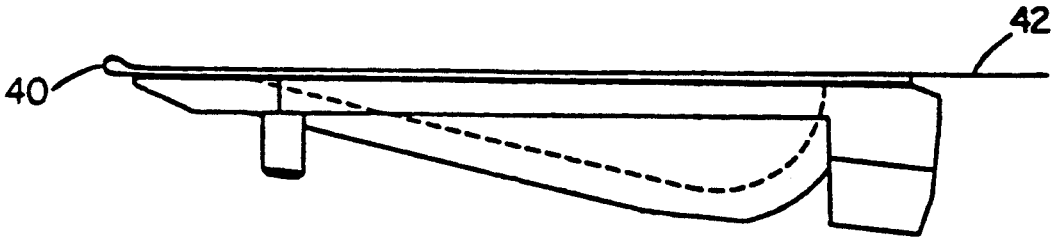
FIG. 8 is a side view of the tray/cover assembly shown in FIG. 7.
Figure 9:
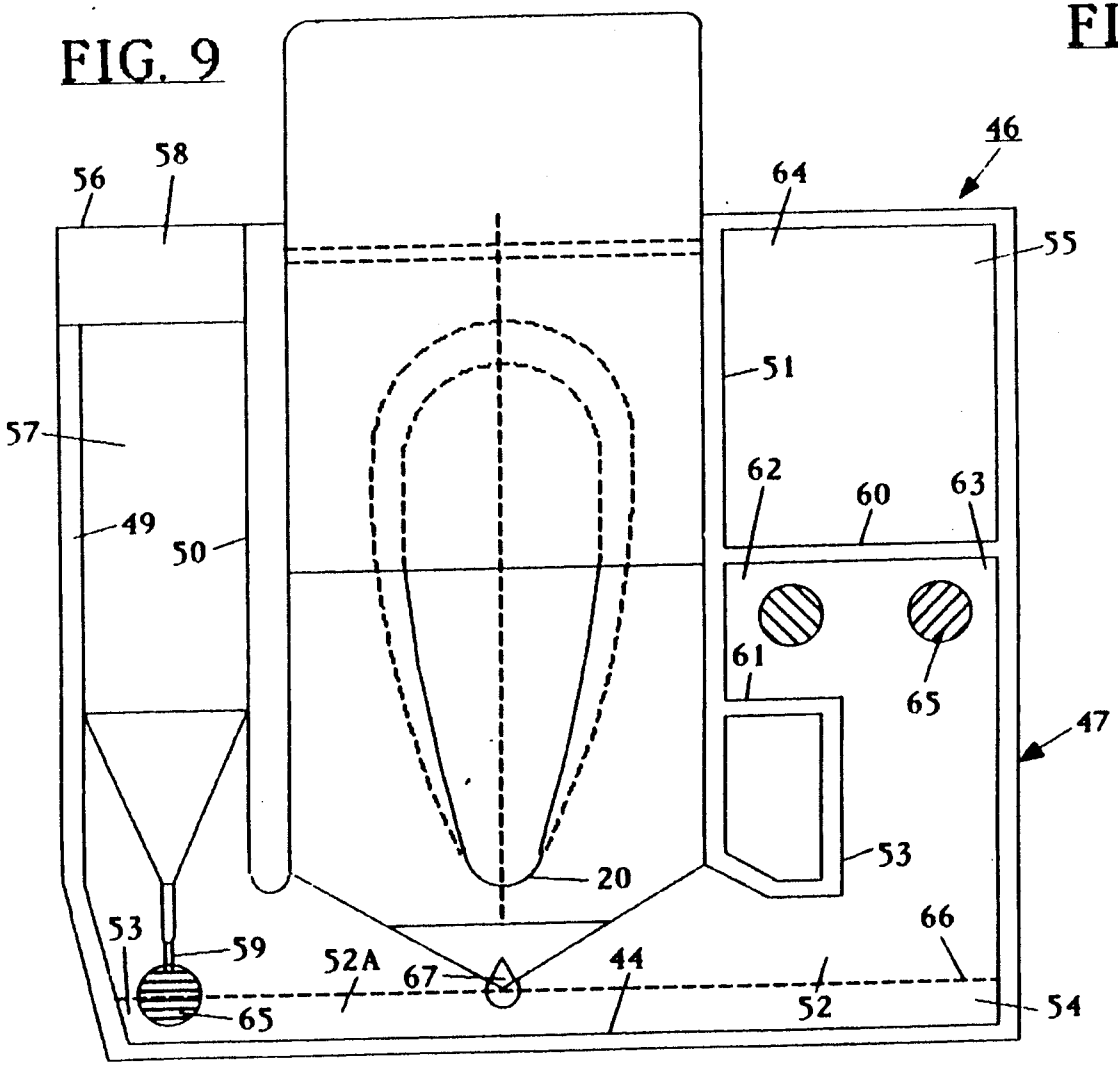
FIG. 9 is a top view illustrating a preferred arrangement for suspending the tray/cover assembly of FIG. 7 within a reaction cartridge for dispensing reagent therein.

According to a feature of this invention, and as best illustrated by FIGS. 7-9, the reagent containment and delivery tray 10 is particularly adapted for effective containment of liquid therein by the provision of a flexible cover 40 which is removably affixed to the top of the tray in such a way as to form a sealed chamber between the liquid containment cavity 12 and the surface of the cover proximal to the cavity. Preferably, the cover 40 is also formed from a plastic laminate having a vapor impermeable aluminum liner and is similar to the material used for the tray body itself.

The cover 40 is removably affixed to the ledge surface 14 of the tray 10 using a heat-activated peelable adhesive between the bottom surface of the cover 40 and the ledge surface 14 of the tray 10. Accordingly, after the liquid reagent has been sealed within the tray cavity by using the heat-activated adhesive to bond the flexible cover to the ledge surface, the cover can conveniently be pulled away from the ledge surface in a direction parallel to the longitudinal axis of the cavity opening, thereby releasing liquid from the containment cavity at the point of liquid discharge 20.

More specifically, the flexible cover is affixed in such a way as to extend beyond the apex 22 of the ledge surface 14 so as to define a tab portion which can be easily grasped and pulled from the ledge surface to remove the cover therefrom. According to a preferred embodiment, the portion of the flexible cover extending beyond the apex of the ledge surface is folded back upon itself in such a way as to further extend beyond the edge of the ledge surface which is distal to the apex. As best seen in FIG. 8, the cover 40 is folded back upon itself at the apex end of the ledge surface and further extends beyond the ledge surface at the end distal from the apex, i.e., the end proximate to the broad curved end of the cavity opening 13, to define a tab portion 42 for assistance in peeling the cover back when liquid is to be dispensed from the tray.

This type of arrangement is particularly advantageous in using the reagent containment and delivery tray of this invention in conjunction with a reaction cartridge wherein the tray is suspended prior to delivery in an upstanding position with the point of liquid discharge pointing downward and in proximity to a support surface on the reaction cartridge. Such an arrangement is instrumental in realizing efficient gravity flow delivery of the liquid reagent contained within the tray. When the tray is suspended within a reaction cartridge in the above-described upright position, the extended tab portion 42 resulting from the folding back of the cover 40 upon itself provides a means for grasping the cover and peeling it off the ledge surface of the tray.

An exemplary reaction cartridge arrangement adapted for supporting liquid delivery means, such as the reagent containment and delivery tray described above, in a manner conducive to introduction of liquid reagent into a reaction channel during the course of performing an analytical assay procedure is described in detail in U.S. patent application Ser. No. 378,039, filed Jul. 11, 1989, the patent rights to which are also owned by the assignee of the present application. The disclosure in that application is incorporated herein in its entirety by reference.

Figure 10:
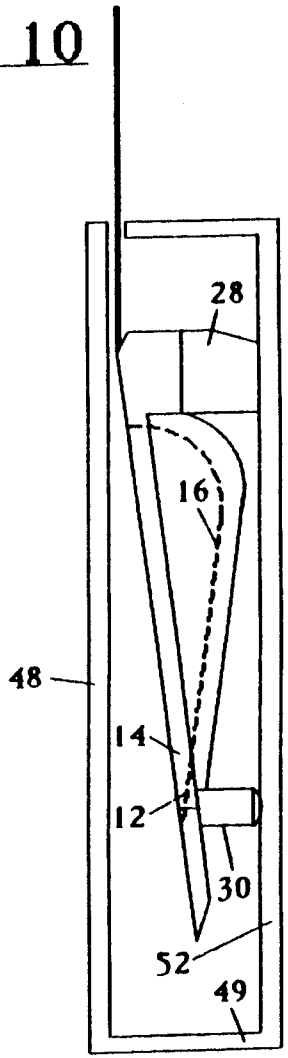
FIG. 10 is a side view of the reaction cartridge/tray arrangement of FIG. 9.

FIGS. 9 and 10 provide an illustration of the preferred manner in which the reagent containment and delivery tray of this invention is mounted relative to a support surface 44 of a reaction cartridge 46 of the type disclosed in the above-referenced patent application, into which liquid reagent is to be dispensed. The reaction cartridge 46 is in the form of a substantially square cassette or container having a substantially horizontal axis of rotation and comprises an open body member 47 which is closed, after analytical reagents have been incorporated therein, by a corresponding lid member 48, in such a way as to realize a fluid-tight seal therebetween. Conventional sealing techniques, such as gluing, laser or sonic welding or other such permanent fastening techniques may be used for this purpose.

The body member 47 comprises a perimeter side wall 49 and first and second inner walls 50 and 51, respectively, situated on and substantially perpendicular to an outer support wall 52. The side wall 49 and the first and second inner walls 50 and 51 are substantially equal in height so that when the body member 47 is closed by the lid member 48, the inner surface of the lid member 48 rests substantially against the upper edges of the perimeter side wall 49 and the first and second inner walls 50 and 51 so as to be sealed to the body member 47 in a fluid-tight manner.

The side wall 49, together with the contiguous portions to lid member 48 and support wall 52 forms an analytical reaction channel 52A which extends around the perimeter of side wall 49 and forms first, second and third corners 53, 54, and 55 which provide means for disrupting the flow of a liquid mixture upon agitation in contact therewith. In addition, the corners can, if desired, also serve as one or more viewing zones for detection and measurement of the detectable response provided by a liquid reaction mixture. For this purpose, the lid member 48 and the side wall 49 can be formed with a substantially transparent cuvette window (not shown) in a particular corner to permit the accurate measurement of detectable signals such as absorbance or turbidity.

The arrangement is such that a liquid disposed in reaction channel 52A can be freely transported by gravity along the channel 52A and between corners 53, 54 and 55, by rotating the reaction cartridge 46 about its horizontal axis. Preferably, a portion of the analytical reaction channel 52A is U-shaped and formed by a third inner wall 60 which extends between and substantially perpendicular to the second inner wall 51 and the side wall 49, and a fourth inner wall 61 which extends from the second inner wall 51. Accordingly, a third corner 62 is formed by and between the second, third and fourth inner walls 51, 60 and 61, respectively, and a fourth corner 63 is formed by the side wall 49 and the third inner wall 60. The third inner wall 60, thus, renders a closed area 64 (which includes the corner 55) of the body member 47 non-functional. However, the third and fourth inner walls 60 and 61 can be dispensed with, modified or otherwise reconfigured to render the area 64 functional and make use of the corner 55 associated therewith.

The reaction cartridge 46 may further include one or more analytical reagent zones 65 which are situated along the reaction channel 52A or at any surface which will be contacted by a liquid disposed therein. The reagent zones 65 preferably incorporate analytical reagents required for performing a particular analytical procedure in a substantially dry, water soluble, suspendable, or dissolvable form. Such reagent zones 65 are incorporated, using known methods such as non-covalent binding or absorptive techniques or the like, along the reaction channel 52A either in areas proximate to or generally between corners 53, 54, 62 and 63 in the desired order in which they are to be sequentially contacted with a liquid test sample. The reagent zones may also be formed as reagent pads or films incorporated with an analytical reagent and attached to a surface of reaction channel 52A on the inner surface of lid member 48 along the channel.

As also shown in FIG. 9, the reaction cartridge 46 includes an inlet port 56 situated along the side wall 49 at the proximal end of reaction channel 52A for introducing a test sample into the channel by using a pipet or like instrument. Preferably, a capillary holder 57 is provided for purposes of sample introduction and comprises a distal end 58 configured to matably engage with the inlet port 56, and a proximal end including a capillary sampling tube 59 for introducing a predetermined amount of a liquid test sample into the cartridge 46. The liquid capacity of the capillary tube 59 and, accordingly, its size will vary in accordance with the particular analytical assay procedure to be performed in the cartridge 46. When a pipet or like instrument is used in place of the capillary holder 57, the inlet port 56 can be closed with a plug member (not shown) or other such means for preventing the loss of liquid during the course of an assay.

In the reaction cartridge 46 shown in FIGS. 9 and 10, the first and second inner walls 50 and 51 function as means for supporting some form of liquid delivery reservoir adapted to contain and deliver therefrom a buffer and/or liquid reagent for performing an analytical assay procedure. The reagent containment and delivery tray of this invention is particularly adapted for use as the liquid delivery reservoir with reaction cartridges of the above-described type. According to a preferred arrangement, as best illustrated in FIG. 9, the tray is vertically positioned between the side walls 50 and 51 with its point of discharge 20 in proximity with the support surface 44 of the reaction cartridge 46. Preferably, the mounting arrangement is such that the vertical distance between the apex of the ledge surface 14 and the support surface 44 on the reaction cartridge 46 is less than the vertical height of the liquid 66 that results on the support surface 44 upon discharge of the liquid reagent from the delivery tray.

The significance of such a dispensing arrangement is that any drops of liquid which cling to the apex portion of the delivery tray are washed off by fluid motion within the reaction cartridge itself. Consequently, it is ensured that substantially all of the liquid contained within the containment cavity is dispensed into the reaction cartridge by counteracting the effect of any capillary action or other surface interactions about the apex end of the ledge surface. As particularly illustrated in FIG. 9, any remaining drop 67 (shown in exaggerated size in FIG. 9) of discharged liquid reagent remaining about the apex end of the ledge surface is washed off the tip of the delivery tray by virtue of fluid movement within the reaction cartridge since the apex of the ledge surface either touches or extends into the fluid discharged from the tray into the reaction cartridge.

Figure 6:
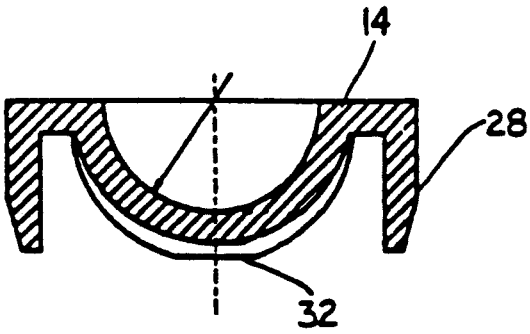
FIG. 6 is a sectional end view of the reagent tray taken substantially along the line B—B in FIG. 1.

According to an illustrative embodiment of a reagent containment and delivery tray of the type described above and particularly adapted for typical lab applications, the tray has an overall length extending from the apex of the ledge surface to its end surface distal from the apex of about 1.83 inches. The oblong teardrop-shaped cavity itself has a length of about 1.31 inches and is centrally disposed about the longitudinal axis of the tray, as illustrated in the top view of FIG. 2. The radius of curvature R of the liquid containment cavity, as represented in the sectional views of FIGS. 5 and 6, is approximately 0.250 inch and the angle of convergence of the cavity surfaces at the point of liquid discharge is selected to be between about 75 degrees and about 30 degrees.

In a preferred arrangement for mounting such a tray within a reaction cartridge, the tip of the cavity from which the fluid is dispensed, i.e., the point of liquid discharge, is disposed within about 0.250 inches of the support surface of the reaction cartridge when the device is mounted therein. Further, the end of the device proximal to the support surface of the reaction cartridge, i.e., the apex of the ledge surface, is selected to be within 0.010 inches of the support surface of the reaction cartridge. A liquid containment and delivery tray having the above-stated dimensions provides a cavity serving as a reservoir for about 600 microliters of liquid reagent.

The dimensions of the reaction cartridge with which the tray is used are such that, in combination with the mounting specifications stated above, the vertical distance between the apex of the ledge surface of the tray in its mounted position within the reaction cartridge and the support surface on the reaction cartridge is less than the vertical height of liquid that results on the support surface upon discharge of substantially all of the liquid contained within the tray. The arrangement, thus, ensures that delivery imprecision as a result of capillary reaction or other fluid retaining forces at the dispensing end of the tray is avoided. More specifically, experimental tests have revealed that such a dispensing arrangement realizes a coefficient of variation of delivery of the dispensed liquid which is less than one percent.

In order to ensure that substantially the complete volume of liquid contained within the tray is dispensed by gravity flow upon removal of the flexible cover from the tray, it is important that no portion of the molded cavity, the sealing surface of the flexible cover, and the apex section of the ledge surface across which the liquid is delivered include any junction or surface which can serve as a basis for capillary action or other surface interactions and possibly result in the retention of liquid which should otherwise be delivered out of the tray. This is essentially achieved by means of the smoothly curved surfaces which define the teardrop-shaped cavity which, as shown in the embodiment of FIGS. 1–6, has a maximum depth about a bottom portion defined about the broad base which converges to the point of liquid discharge, and has a minimum depth at a top portion defined about the discharge point.

It must also be ensured that the seal between the flexible cover and the tray body detaches cleanly when the cover is pulled away from the tray to dispense the liquid contained therein. It is important that the adhesive used to establish the seal by affixing the cover to the ledge surface leave substantially no residue upon removal thereof by grasping and pulling the cover from the ledge surface of the tray. Also, the material of which the flexible cover is formed should be such that the cover does not rupture or tear as it is pulled away from the tray for dispensing the liquid.

Preferably, the plastic material used for molding the above-described tray is selected to have negligible fluid absorption properties so that the volume of contained liquid is not unduly affected by the material of the tray itself. More specifically, the material is preferably such that it absorbs about 10 milligrams, and more preferably, no more than 6.25 milligrams, of fluid over 18 months of storage within the tray at an ambient temperature of 25 degrees centigrade, thereby ensuring that the volume of liquid dispensed corresponds accurately to the volume initially filled into the tray.

Another factor that must be taken into account in realizing optimal delivery and minimal coefficient of variation in delivery is the loss of liquid reagent resulting from the heat sealing operation used to affix the cover to the tray and from natural vapor loss during the storage of a sealed tray. Any evaporation resulting from the heat sealing operation is preferably restricted to less than about 1.0 percent, and more preferably to less than 0.5 percent, of the overall liquid volume. Further, natural vapor loss from the sealed tray is preferably restricted to less than about 5.0 milligrams, and more preferably to less than 3.0 milligrams, over a period of 18 months at an ambient temperature of 25 degrees centigrade.

In order to make the reagent containment and delivery tray compatible with conventional air shipping requirements, the heat seal between the flexible cover and the ledge surface of the tray is preferably made capable of withstanding a vacuum of less than ⅛ of an atmosphere for a period of up to eight hours. In addition, in order to facilitate the testing of the heat sealing integrity during manufacture, the heat seal is preferably made capable of withstanding a burst/leak pressure test of about ten (10) psi of air for about 20–30 seconds.

It is also important that a minimum amount of force be required to adequately peel the sealed flexible cover from the delivery tray. Preferably, this peeling force is designed to be less than about 3.0 pounds, and more preferably, less than 1.5 pounds, over a storage period of 18 months at about 25 degrees centigrade. Further, for efficient removal of the sealed cover, the material of the cover is preferably thick enough that the cover itself can serve as a tab portion for directly pulling back the cover. Alternatively, a tab attachment may be affixed to the cover for assistance in removal of the cover.

In view of the foregoing, it will be apparent that the present invention provides a liquid reagent containment and delivery tray which is simple in construction and is specifically adapted for use with a removable cover so as to define a sealed chamber for liquid storage. The device is particularly adapted for convenient and accurate gravity flow delivery from an upright tray position into a reaction cartridge by peeling the cover back along a longitudinal axis of the tray so as to deliver substantially the entire volume of liquid contained therein.

We claim:

1. A device for the accurate gravity-flow delivery of a liquid analytical reagent, comprising:

(i) a formed tray defining a cavity, a substantially planar ledge surface defined around the opening of said cavity, said planar ledge surface having an apex, and first and second support means depending from the planar ledge, said first support means being provided at a first end of the tray near the apex and said second support means being provided at a second end of the tray distal from the apex, said first support means being shorter than said second support means such that when said first and second support means abut a planar surface, said planar ledge is supported at an angle from the planar surface, said cavity being defined by a smoothly curved surface substantially devoid of angular sections or obstructions, said cavity smoothly converging to a point of liquid discharge at an intersection of said cavity and said ledge surface, wherein said apex extends longitudinally from said point of liquid discharge;

(ii) a flexible cover removably affixed to said ledge surface of said tray to seal said cavity formed therein, thereby forming a sealed chamber between said cavity and said affixed cover, said cover extending beyond said apex to the ledge surface to define a tab portion which can be grasped and pulled from said ledge surface to remove said cover, said tab portion adapted to being folded back upon itself so as to extend beyond the second end of said tray in order to facilitate removal of said cover when said tray is disposed in a vertical position with said point of liquid discharge being directed downward, and (iii) a predetermined amount of a liquid analytical reagent disposed within said sealed chamber formed between said tray and said flexible cover, wherein the removal of said flexible cover from the ledge surface of said tray of grasping and pulling said folded back and extending tab portion from said ledge surface, with said tray disposed in a substantially vertical position with the point of liquid discharge directed downward, provides gravity flow delivery of substantially the entire volume of said liquid analytical reagent.

2. The reagent delivery device of claim 1, wherein said cover is affixed to said ledge surface by bonding means which leaves substantially no residue upon removal thereof by grasping and pulling said cover from said ledge surface.

3. The reagent delivery device of claim 1, wherein said tray is constructed to be sufficiently rigid that no substantial deformation of the cavity occurs upon said removal of said flexible cover from the ledge surface.

4. The reagent delivery device of claim 1, wherein said apex in the ledge surface converges essentially to a single point for directing said liquid out of said cavity.

5. The reagent delivery device of claim 1, wherein the angle of convergence of the cavity surfaces at the point of liquid discharge is between about 75° and about 30°.

6. The reagent delivery device of claim 1, wherein said tray and flexible cover are formed of materials which are substantially vapor impermeable.

7. The reagent delivery device of claim 1, wherein the cavity in the formed tray is smoothly curved in a teardrop-shape which tapers to the point of liquid discharge.

8. In combination, (a) a liquid reagent delivery device comprising:

(i) a formed tray defining a cavity, a substantially planar ledge surface defined around the opening of said cavity, said planar ledge surface having an apex and first and second support means depending from the planar ledge, said first support means being provided at a first end of the tray near the apex and said second support means being provided at a second end of the tray distal from the apex, said first support means being shorter than said second support means such that when said first and second support means abut a planar surface, said planar ledge is supported at an angle from the planar surface, said cavity being defined by a smoothly curved surface substantially devoid of angular sections or obstructions, said cavity smoothly converging to a point of liquid discharge at an intersection of said cavity and said ledge surface, wherein said apex extends longitudinally from said point of liquid discharge, (ii) a flexible cover removably affixed to said ledge surface of said tray to seal said cavity formed therein, thereby forming a sealed chamber between said cavity and said affixed cover, said cover extending beyond said apex of the ledge surface to define a tab portion which can be grasped and pulled from said ledge surface to remove said cover, and (iii) a predetermined amount of a liquid analytical reagent disposed within said sealed chamber formed between said tray and said flexible cover;

the removal of said flexible cover from the ledge surface of said try by grasping and pulling the tab portion from said ledge surface, with said tray disposed in a substantially vertical position with the point of liquid discharge directed downward, providing gravity flow delivery of substantially the entire volume of said liquid analytical reagent, and (b) a liquid reagent mixing chamber including third support means for cooperating with said first and second support means on said tray in order to support said delivery device in said upstanding position with said point of liquid discharge directed downward and said apex in proximity with a support surface on said chamber, said delivery device being disposed within said mixing chamber by means of said first and second support means on said tray and said third support means on the mixing chamber with the vertical distance between the apex of the ledge surface and said support surface on said chamber being less than the vertical height of liquid that results on said support surface in said mixing chamber upon discharge of the liquid analytical reagent from the delivery device, and said tab portion of said flexible cover extending outside said mixing chamber for being grasped and pulled to remove said cover from said tray.

9. The combination of claim 8, wherein said cover is affixed to sid ledge surface by bonding means which leaves substantially no residue upon removal thereof by grasping and pulling same from said ledge surface.

10. The combination of claim 8, wherein said tray is constructed to be sufficiently rigid that no substantial deformation of the cavity occurs upon said removal of said flexible cover from the ledge surface.

11. The combination of claim 8, wherein said apex in the ledge surface converges essentially to a single point for directing said liquid out of said cavity.

12. The combination of claim 8, wherein the angle of convergence of the cavity surfaces at the point of liquid discharge is between about 75° and about 30°.

13. The combination of claim 8, wherein said tray and flexible cover are formed of materials which are substantially vapor impermeable.

14. The combination of claim 8, wherein the cavity in the formed tray is smoothly curved in a teardrop-shape which tapers to the point of liquid discharge.

15. The combination of claim 8, wherein said predetermined amount of liquid analytical reagent is between 0.25 ml and 2 ml.

16. A method for the accurate delivery of a liquid analytical reagent into a mixing chamber, comprising the steps of:

1) providing the combination of (a) a liquid delivery reagent delivery device comprising:

(i) a formed tray defining a cavity, a substantially planar ledge surface defined around the opening of said cavity, said planar ledge surface having an apex, and first and second support means depending from the planar ledge, said first support means being provided at a first end of the tray near the apex and said second support means being provided at a second end of the tray distal from the apex, said first support means being shorter than said second support means such that when said first and second support means abut a planar surface, said planar ledge is supported at an angle from the planar surface, said cavity being defined by a smoothly curved surface substantially devoid of angular sections or obstructions, said cavity smoothly converging to a point of liquid discharge at an intersection of said cavity and said ledge surface, wherein said apex extends longitudinally from said point of liquid discharge;

(ii) a flexible cover removably affixed to said ledge surface of said tray to seal said cavity formed therein, thereby forming a sealed chamber between said cavity and said affixed cover, said cover extending beyond said apex of the ledge surface to define a tab portion which can be grasped and pulled from said ledge surface to remove said cover, said tab portion adapted to being folded back upon itself so as to extend beyond the second end of said tray in order to facilitate removal of said cover when said tray is disposed in a substantially vertical position with said point of liquid discharge being directed downward, and (iii) a predetermined amount of a liquid analytical reagent disposed within said sealed chamber formed between said tray and said flexible cover, the removal of said flexible cover from the ledge surface of said tray by grasping and pulling said folded back and extending tab portion from said ledge surface, with said tray disposed in a substantially vertical position with the point of liquid discharge directed downward, providing gravity flow delivery of substantially the entire volume of said liquid analytical reagent, and (b) a liquid reagent mixing chamber, wherein the delivery device is supported in a substantially vertical position with said point of liquid discharge directed downward and said apex in proximity with a support surface on said chamber, and wherein the vertical distance between the apex of the ledge surface and said support surface on said chamber is less than the vertical height of liquid that results on said support surface in said mixing chamber upon discharge of the liquid analytical reagent from the delivery device, and 2) grasping and pulling the tab portion of the flexible cover from aid ledge surface whereby the entire volume of said liquid analytical reagent flows by gravity into said mixing chamber.

17. The method of claim 16 which comprises the additional step of rotating said mixing chamber to wash the apex of the ledge surface in the delivery device with the liquid mixture formed in the mixing chamber upon discharge of the liquid analytical reagent into said chamber.

18. Apparatus for accurately dispensing small volumes of liquid comprising:

a tray defining a curved cavity serving as a reservoir for holding a predetermined amount of the fluid to be dispensed, said cavity extending downwardly from a substantially teardrop-shaped opening having a broad base which converges to a point of liquid discharge, the depth of said cavity decreasing gradually from a maximum about a bottom portion defined about said broad base to a minimum at a top portion defined about said discharge point, said cavity being defined by a smoothly curved surface substantially devoid of angular sections or obstructions, said tray including a substantially planar ledge surface defined around the opening of said cavity and extending longitudinally from said point of discharge along the plane of said opening to a pointed apex so as to define a path for directing said fluid out of said cavity with first and second support means depending from the planar ledge said first support means being provided at a first end of the tray near the apex and said second support means being provided at a second end of the tray distal from the apex, said first support means being shorter than said second support means such that when said first and second support means abut a planar surface, said planar ledge is supported at an angle from the planar surface, and a flexible cover adapted to be removably affixed to said ledge surface for sealing said cavity, said cover extending beyond said apex portion of said ledge surface to define a tab portion of said ledge surface to define a tab portion which may be grasped and pulled from said ledge surface to remove said cover in order to deliver said fluid out of said cavity, said tab portion adapted to being folded back upon itself so as to extend beyond the second end of said tray in order to facilitate removal of said cover when said tray is disposed in a vertical position with said point of liquid discharge being directed downward.

19. The apparatus according to claim 18 wherein said tray and cover are formed of substantially vapor impermeable materials.

20. The apparatus according to claim 18 wherein said tray is formed from a plastic laminate and the external surface of said cavity is lined with a metallic liner acting as a vapor barrier.

21. The apparatus according to claim 18 wherein said tray is formed from high density polyethylene and said cavity is lined with aluminum foil integrally bonded to said polyethylene.

22. The apparatus according to claim 18 wherein said cover is formed of a plastic laminate and lined with metallic liner such as aluminum foil.

23. The apparatus according to claim 18 wherein said cover is removably affixed to said ledge surface by means of a heat sealable adhesive to hermetically seal said fluid within said cavity, said adhesive leaving substantially no residue upon removal of said cover from said ledge surface.

24. A tray for containment and high-precision delivery of small volumes of fluids, comprising:

(i) a base section having a molded curved cavity defined therein, said cavity being substantially devoid of angular surfaces and having an oblong opening with a base leading to a point of discharge said base being broader than the point of discharge, the depth of said cavity decreasing gradually from a maximum about said broad base to a minimum about said point of discharge, said base section including a planar ledge surface extending from the edges of said oblong opening and leading to an apex extending longitudinally from said discharge point to define an outlet for delivery liquid out of the tray with first and second support means depending from the planar ledge, said first support means being provide at a first end of the tray near the apex and said second support means being provided at a second end of the tray distal from the apex, said first support means being shorter than said second support means such that when said first and second support means abut a planar surface, said planar ledge is supported at an angle from the planar surface, and (ii) a flexible cover for sealing said oblong opening, said cover being removably affixed to said ledge surface and including a tab section extending outwardly beyond said apex end of said ledge for being grasped and pulled away from said ledge surface for delivery of liquid contained within said tray, said tab portion adapted to being folded back upon itself so as to extend beyond the second end of said tray in order to facilitate removal of said cover when said tray is disposed in a vertical position with said point of liquid discharge being directed downward.

25. The containment and delivery tray of claim 24 wherein said tray and cover are formed of substantially vapor impermeable materials.

26. The containment and delivery tray of claim 24 wherein said tray is formed from a plastic laminate and said cavity has an external surface lined with a metallic liner acting as a vapor barrier.

27. The containment and delivery tray of claim 24 wherein said cover is removably affixed to said ledge surface by means of a heat sealable adhesive to hermetically seal said fluid within said cavity, said adhesive leaving substantially no residue upon removal of said cover from said ledge surface.

* * * * *